US009314097B2

(12) United States Patent
Choi

(10) Patent No.: US 9,314,097 B2
(45) Date of Patent: Apr. 19, 2016

(54) PORTABLE FOLDING TABLE

(71) Applicant: ANYPLACE CONCEPTS CO., LTD., Xiamen (CN)

(72) Inventor: Kwan Jun Choi, Xiamen (CN)

(73) Assignee: Anyplace Concepts Co., Ltd., Xiamen (CN)

( * ) Notice: Subject to any disclaimer, the term of this patent is extended or adjusted under 35 U.S.C. 154(b) by 0 days.

(21) Appl. No.: 14/832,218

(22) Filed: Aug. 21, 2015

(65) Prior Publication Data

US 2016/0051041 A1 Feb. 25, 2016

(30) Foreign Application Priority Data

Aug. 22, 2014 (CN) ..... 2014 2 0474898 U

(51) Int. Cl.

| | |
|---|---|
| ***A47B 3/00*** | (2006.01) |
| ***A47B 3/04*** | (2006.01) |
| ***A47B 3/12*** | (2006.01) |
| ***A47B 13/00*** | (2006.01) |

(52) U.S. Cl.

CPC ... *A47B 3/04* (2013.01); *A47B 3/12* (2013.01); *A47B 13/003* (2013.01); *A47B 2003/045* (2013.01)

(58) Field of Classification Search

CPC ..... A47B 3/04; A47B 3/12; A47B 13/003; A47B 2003/045

USPC ..... 108/34, 158.12, 67

See application file for complete search history.

(56) References Cited

U.S. PATENT DOCUMENTS

| | | | | | |
|---|---|---|---|---|---|
| 2,023,870 | A * | 12/1935 | Casott | A47B 3/04 | 108/159 |
| 2,713,529 | A * | 7/1955 | Herrschaft | A47B 3/12 | 108/154 |
| 3,884,159 | A * | 5/1975 | Faria | A47B 3/00 | 108/168 |
| 4,341,164 | A * | 7/1982 | Johnson | A47B 3/10 | 108/115 |
| 5,890,437 | A * | 4/1999 | Hill | B65D 19/0026 | 108/51.11 |
| 6,125,769 | A * | 10/2000 | Tsai et al. | A47B 3/002 | 108/118 |
| 6,401,630 | B1 * | 6/2002 | Peterson | A47C 17/62 | 108/115 |
| 6,619,601 | B1 * | 9/2003 | Vall | A47B 13/02 | 108/158.12 |
| 7,644,665 | B2 * | 1/2010 | Creighton et al. | B65D 19/0026 | 108/56.3 |
| 2003/0233966 | A1 * | 12/2003 | Zheng | A47B 3/02 | 108/115 |
| 2004/0250739 | A1 * | 12/2004 | Yang | A47B 1/06 | 108/67 |

* cited by examiner

*Primary Examiner* — Hanh V Tran

(74) *Attorney, Agent, or Firm* — Morgan, Lewis & Bockius LLP

(57) ABSTRACT

An improved portable folding table includes a folding frame and a table top supported by the folding frame. The folding frame includes a connecting sleeve, supporting blocks, supporting rods coupled to the connecting sleeve and the supporting blocks and first/second cross-bars coupled to the supporting blocks. The table top includes a tablecloth, third/fourth cross-bars at the bottom of the tablecloth and coupled to the supporting blocks, auxiliary cross-bars positioned between the third and fourth cross-bars and holders fixedly attached to the bottom of the tablecloth to receive ends of the auxiliary cross-bars. The holders prevent the auxiliary cross-bars from sliding out during normal operation.

12 Claims, 9 Drawing Sheets

PORTABLE FOLDING TABLE

CROSS-REFERENCE TO RELATED APPLICATION

The present application claims priority of Chinese Utility Model No. 201420474898.1 filed Aug. 22, 2014, the entire contents of which application is incorporated herein for all purposes by this reference

FIELD OF INVENTION

The present invention relates to a table and in particular to an improved portable folding table.

BACKGROUND OF INVENTION

A folding table is convenient to transport and carry, and it is often used in temporary venues for banquets, conferences and exhibitions, etc., as well as on outings. An existing folding table, for instance the China Utility Model "A Portable Folding Table" with authorized proclamation No. CN 202874322 U, comprises a folding frame and a table top, wherein, the folding frame is a folding frame structure made of four sets of stainless steel tubes (totaling 8 pieces, 2 pieces for each set) through folding a transition connector; the table top is a square canvas surface; the folding frame is arranged at the bottom of the table top; the table top is arranged horizontally on the folding frame, and the four corners below the table top are connected with the folding frame fixedly.

After being folded, such portable folding tables become small-sized and convenient to carry. However, there are some problems in use: the canvas with certain elasticity is used in the table top, and the four corners of the canvas are fixed on the folding frame, and when some heavy objects are placed on that table, subjected to the pressure of the objects, the canvas may stretch to some extent, resulting in a depression in the location where the objects are placed; if an object is placed in the center of the table, under the effect of gravity, other objects outside the table center may slide towards the table center, causing object accumulation and collision; when a glass is placed on the table, it may cause an overturned glass. Therefore, such portable folding tables are inconvenient in some occasions actually.

As a solution to this problem, Applicant put forward a portable folding table, and has submitted a patent application to the State Intellectual Property Office of China. It comprises a folding frame and a cloth table top arranged on the folding frame, characterized in that, the folding frame comprises a connecting sleeve and four supporting rods hinged to the connecting sleeve respectively; the lower end of each supporting rod is provided with a contact part for contacting with floor, and the upper end of each supporting rod is connected with a supporting block which is used for supporting the table top; the supporting block is arranged with a first slot and a second slot; the four supporting blocks are arranged as the first supporting block, the second supporting block, the third supporting block and the fourth supporting block clockwise; a first cross-bar is arranged between the first slots of the first and second supporting blocks; a second cross-bar is arranged between the first slots of the third and fourth supporting blocks; the table top comprises a tablecloth, as well as a third cross-bar and a fourth cross-bar arranged on both sides of the bottom face of the tablecloth, in which, the third cross-bar is arranged between the second slots of the second and third supporting blocks while the fourth cross-bar is arranged between the second slots of the fourth and first supporting blocks; the bottom face of the table top is also arranged with a plurality of auxiliary cross-bars fixedly, which are positioned between the third and fourth cross-bars and are set up between the first and second cross-bars.

In the solution, the third cross-bar, the fourth cross-bar and the auxiliary cross-bar are arranged in parallel and all are fixed on the bottom face of the table top with stitches. In actual production, generally, a piece of cloth laid along the length direction of the cross-bar is used as a connecting piece. The cloth and the bottom face of the table top are used to encircle the cross-bar, and a plurality of stitches are used between the table top and the cloth along the length direction of the cross-bar so as to fix the cross-bar on the table top. In this way, it's required to make the stitches adjoin the cross-bar so as to form sufficient pressure between the table top and the cloth, ensuring that the cross-bar doesn't slide out. The processing is cumbersome with low efficiency. Moreover, after the cross-bar is fixed, it's difficult to dismantle. Furthermore, when there's sufficient clamping force formed between the table top and the cloth, the table top corresponding to the location where the cross-bar is arranged is easy to arch, causing an uneven table top, affecting the use and aesthetic sense of the table top.

Given the above background, there is a need in the art for an improved portable folding table that is easy to manufacture and convenient to use, and has an attractive table top.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

One of objectives of the present invention is to provide an improved portable folding table that is easy to make and convenient to use with an attractive table top.

To achieve the aforesaid and/or other objectives, the present invention provides an improved portable folding table that includes a folding frame and a cloth table top arranged on the folding frame.

In various aspects, the folding frame comprises: (i) a connecting sleeve; (ii) a plurality of supporting blocks including first, second, third and fourth supporting blocks arranged clockwise, wherein each of the first, second, third and fourth supporting blocks includes a first slot and a second slot; (iii) a plurality of supporting rods coupled to the connecting sleeve, wherein a lower end of each supporting rod is configured to contact a floor, and an upper end of each supporting rod is connected with a correspond supporting block; (iv) a first cross-bar disposed in the first slots of the first and second supporting blocks; and (v) a second cross-bar disposed in the first slots of the third and fourth supporting blocks. The table top comprises: (i) a tablecloth; (ii) a third cross-bar formed at a bottom of the tablecloth and along one side of the tablecloth, the third cross-bar configured to be disposed in the second slots of the second and third supporting blocks; (iii) a fourth cross-bar formed at the bottom of the tablecloth and along another side of the tablecloth, the fourth cross-bar configured to be disposed in the second slots of the fourth and first supporting blocks; (iv) a plurality of auxiliary cross-bars positioned between the third and fourth cross-bars; and (v) a plurality of holders fixedly attached to the bottom of the tablecloth to receive ends of the plurality of auxiliary cross-bars.

In one aspect, each holder includes an opening part for inserting a corresponding auxiliary cross-bar and an abutting part for restricting the corresponding auxiliary cross-bar from sliding out. In another aspect, two holders are provided to each auxiliary cross-bar, with one holder at each end of the auxiliary cross-bar, wherein at least one holder is formed with a through-hole between the abutting part and the opening part to allow the corresponding end of the auxiliary cross-bar to extend.

In some aspects, one or more holders are made of a piece of fabric, wherein: both edges of the fabric in a width direction of a corresponding auxiliary cross-bar are stitched to the tablecloth; one edge of the fabric in a length direction of the corresponding auxiliary cross-bar is stitched to the tablecloth to form the abutting part; the other edge of the fabric in the length direction of the corresponding auxiliary cross-bar is open to form the opening part; a through hole is formed in the fabric between the two stitched edges in the width direction of the corresponding auxiliary cross-bar; and the fabric and the bottom of the table top collectively form an inner chamber of the holder, a width of which in the width direction of the corresponding auxiliary cross-bar is larger than that of the corresponding auxiliary cross-bar.

In an aspect, the improved portable folding table of the present invention further comprise: a plurality of second holders fixedly attached to the bottom of the tablecloth to receive the third cross-bar, with one second holder at each end of the third cross-bar along a length direction of the third cross-bar, wherein each second holder includes a second opening part for inserting the third cross-bar and a second abutting part for restricting the third cross-bar from sliding out, and at least one second holder is formed with a second through-hole between the second abutting part and the second opening part to allow the corresponding end of the third cross-bar to extend.

In an aspect, the improved portable folding table of the present invention further comprise: a plurality of third holders fixedly attached to the bottom of the tablecloth for receiving the fourth cross-bar, with one third holder at each end of the fourth cross-bar along a length direction of the fourth cross-bar, wherein each third holder includes a third opening part for inserting the fourth cross-bar and a third abutting part for restricting the fourth cross-bar from sliding out, and at least one third holder is formed with a third through-hole between the third abutting part and the third opening part to allow the corresponding end of the fourth cross-bar to extend.

In an aspect, the plurality of supporting rods includes four supporting rods. The connecting sleeve has a substantially cuboid shape and comprises a plurality of guide slots for the plurality of supporting rods to abut. Each slot in the plurality of guide slots extends through the top and bottom of the connecting sleeve. The plurality of guide slots includes four guide slots formed evenly in the connecting sleeve and corresponding to four side walls of the connecting sleeve. The plurality of supporting rods is hinged to the connecting sleeve. The first slot and the second slot of one or each supporting block are substantially perpendicular to each other. The first slot and the second slot of one or each supporting block is substantially perpendicular to each other. The third cross-bar, the fourth cross-bar and the plurality of auxiliary cross-bars are substantially parallel to each other.

In the present invention, the holders receive the two ends of the auxiliary cross-bars. The abutting part of a holder restricts a corresponding auxiliary cross-bar from sliding out of the holder, and the through-hole formed in the holder is for the convenience of installing and dismantling the corresponding auxiliary cross-bar.

For installation, insert the first end of an auxiliary cross-bar into the through-hole and through the opening part of a first holder, then insert the first end of the auxiliary cross-bar into the opening part of a second holder and let it abut against the abutting part of the second holder. At this moment, push the second end of the auxiliary cross-bar into the first holder from the through-hole of the first holder. To take out the auxiliary cross-bar, simply push the second end of the auxiliary cross-bar out of the through-hole of the first holder and pull the auxiliary cross-bar until the first end of the auxiliary cross-bar is separated from the first holder. In this way, it's only required to arrange the holders at the bottom of the table top. It's convenient for manufacturing and use. It allows rapid installation and dismantlement of the auxiliary cross-bars. In addition, neither the holders nor the tablecloth would produce large pressure on the auxiliary cross-bars, ensuring a smoother and more attractive table top when in use.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
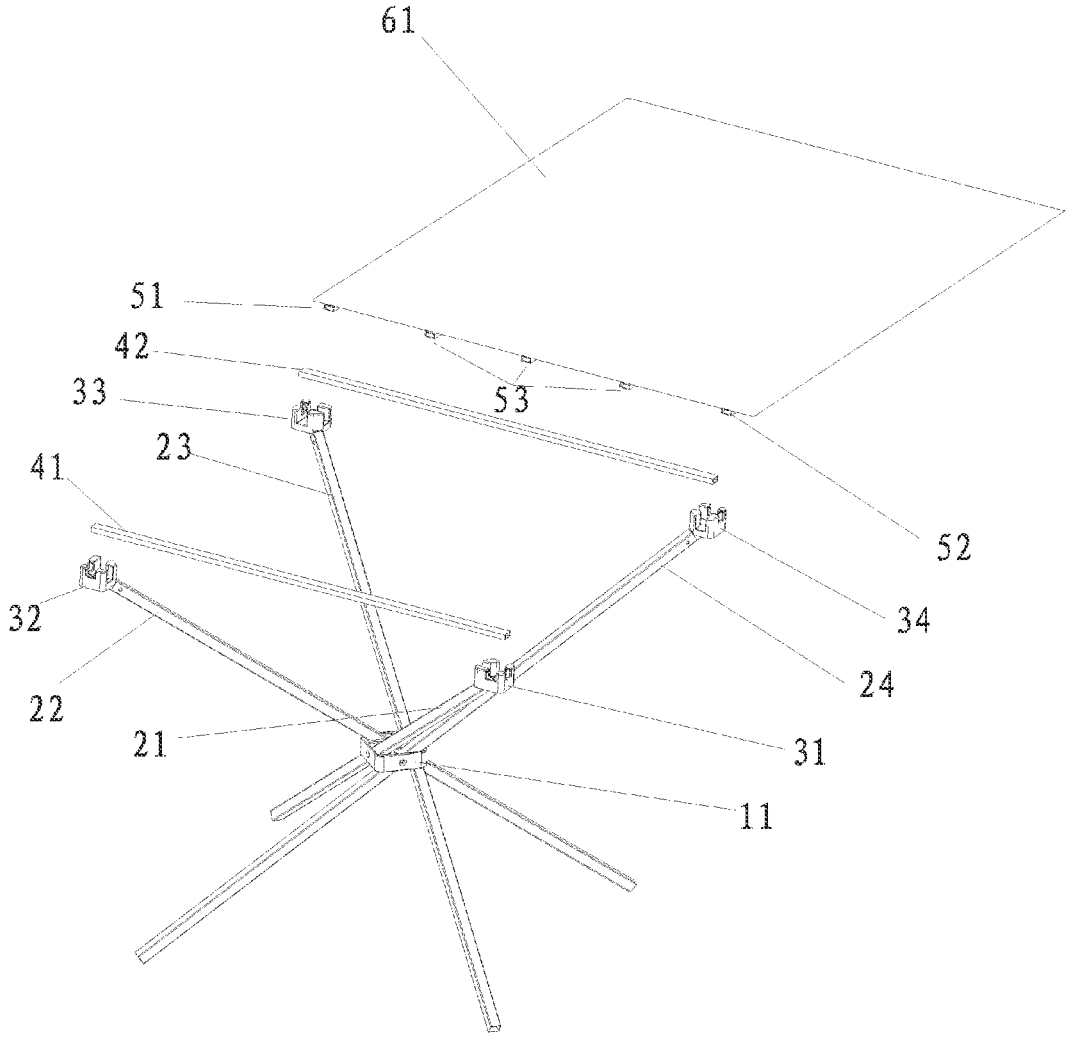
FIG. 1 (Related Art)
FIG. 1 is an exploded structure diagram of a portable folding table in related art.
Figure 2:
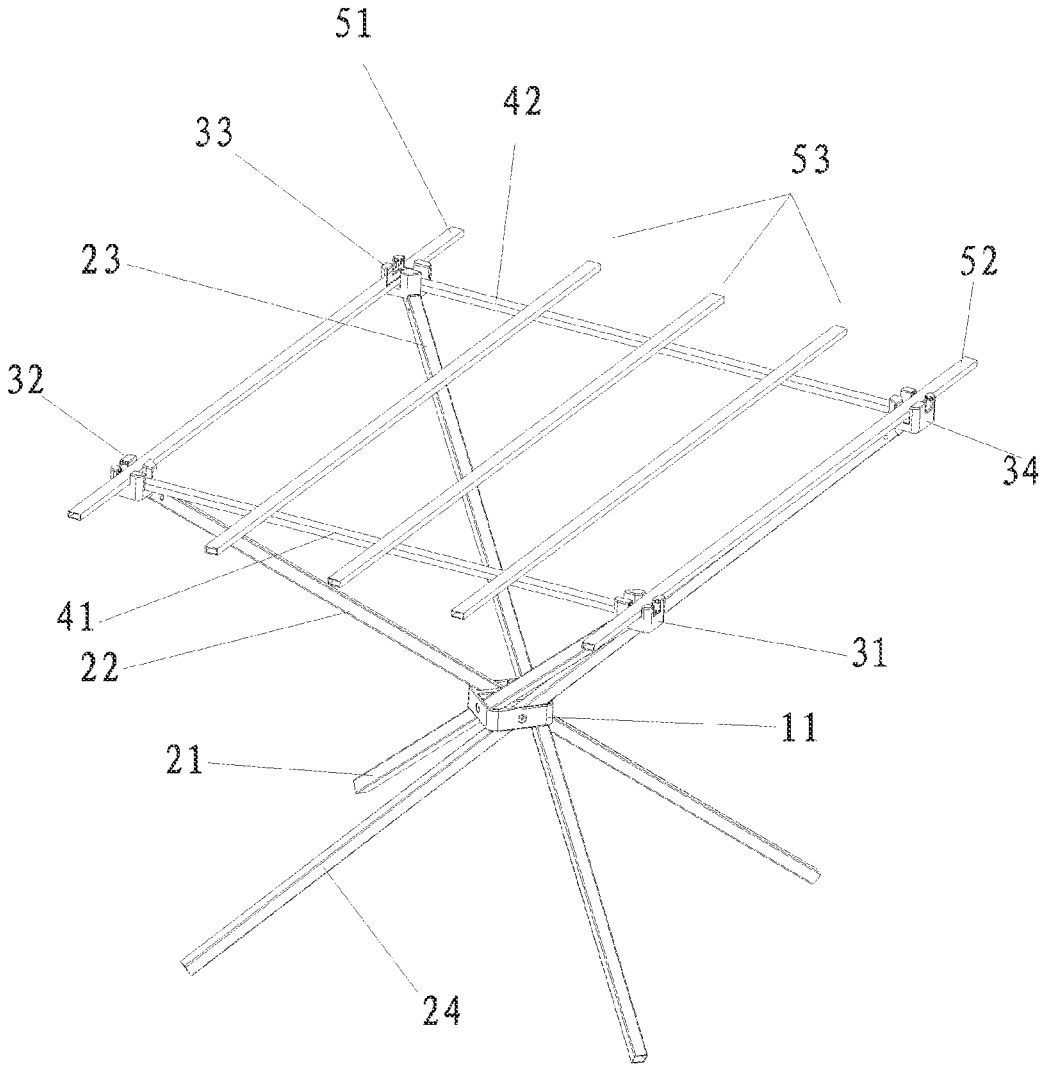
FIG. 2 (Related Art)
FIG. 2 is a structure diagram of the portable folding table in related art (the tablecloth is not shown).
Figure 3:
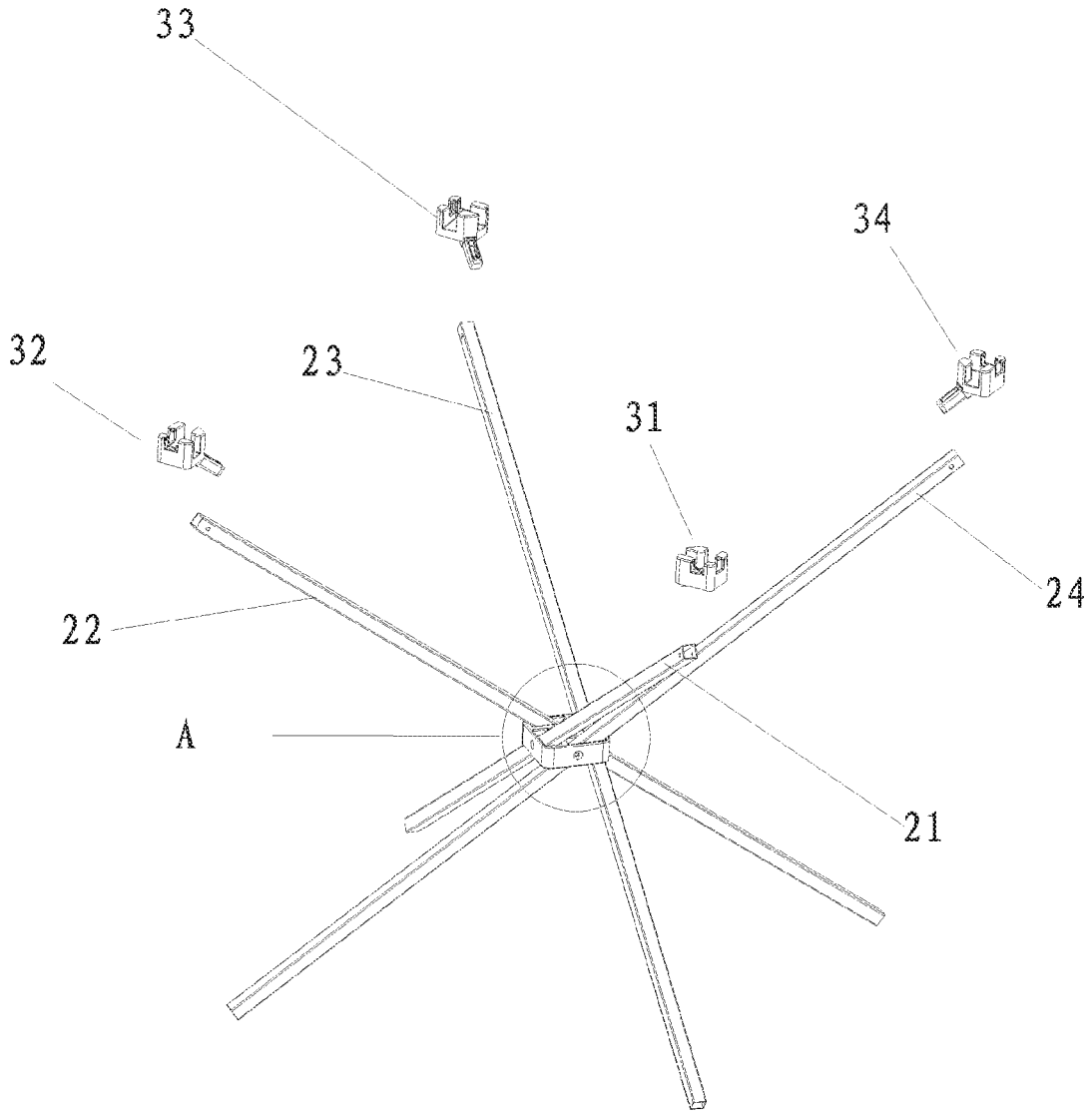
FIG. 3 (Related Art)
FIG. 3 is an unfolded state diagram of the folding frame of the portable folding table in related art.
Figure 4:
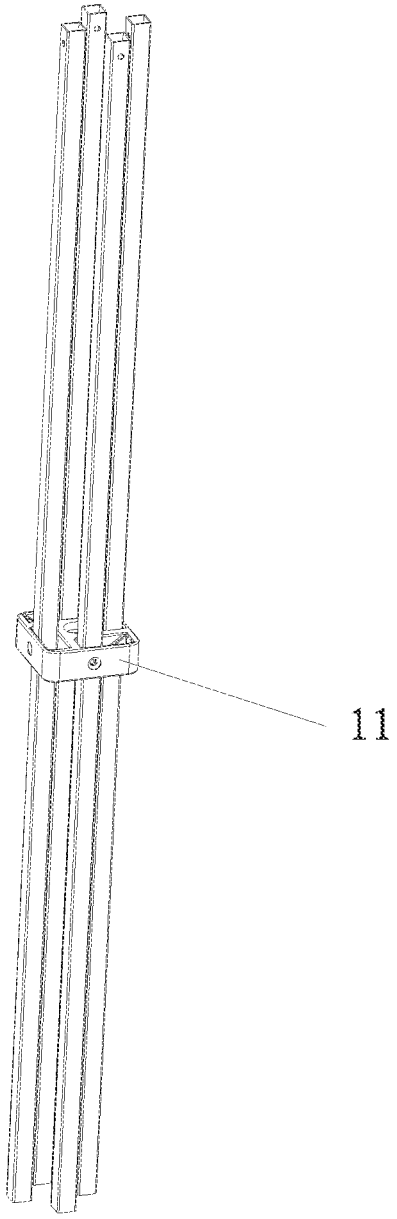
FIG. 4 (Related Art)
FIG. 4 is a folded state diagram of the folding frame of the portable folding table in related art.
Figure 5:
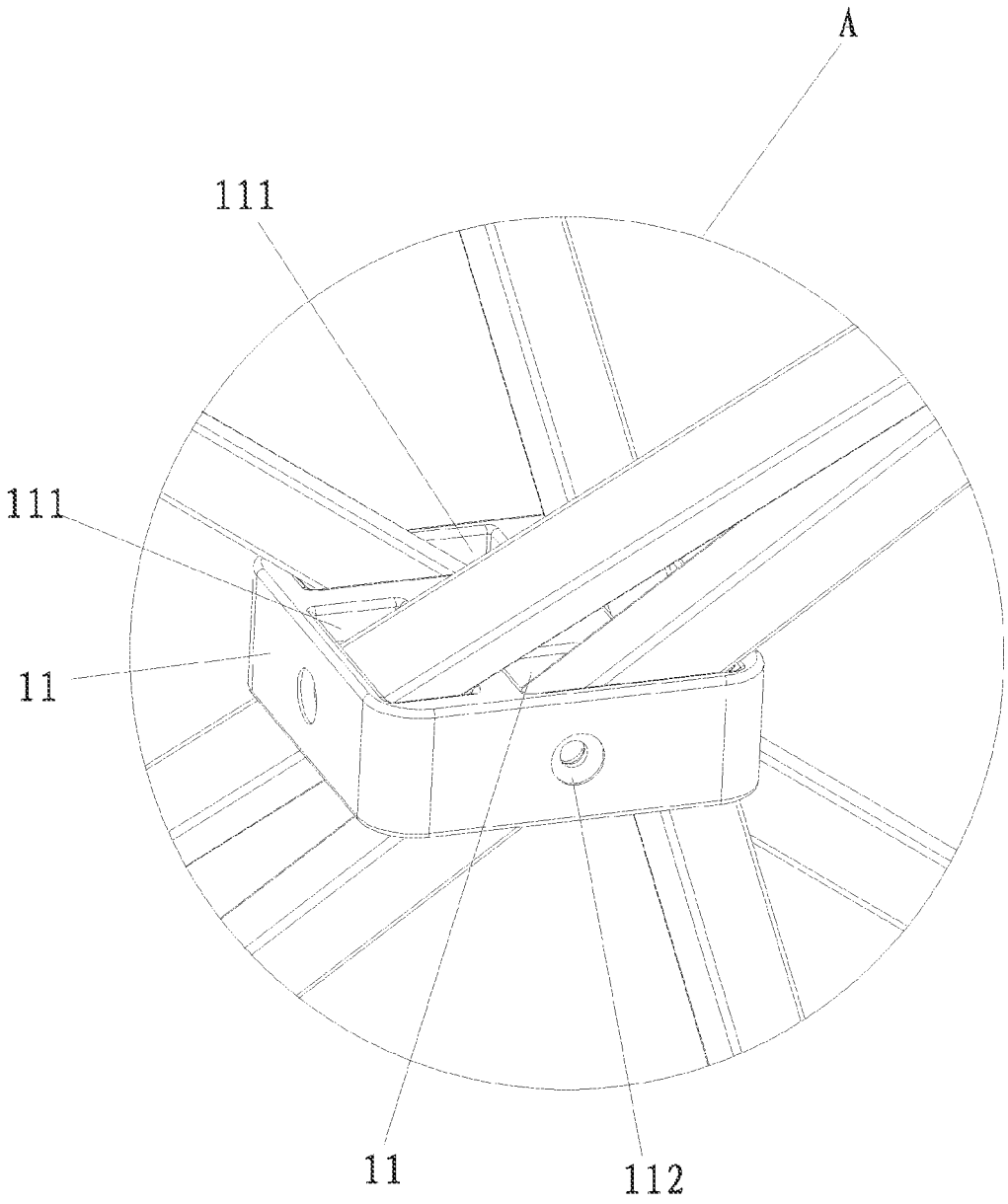
FIG. 5 (Related Art)
FIG. 5 is an enlarged view of A as shown in FIG. 3.

| | | | |
|---|---|---|---|
| 11 | Connecting sleeve | 111 | Guide slot |
| 112 | Hinged aperture | 21 | First supporting rod |
| 22 | Second supporting rod | 23 | Third supporting rod |
| 24 | Fourth supporting rod | 3 | Supporting block |
| 31 | First supporting block | 32 | Second supporting block |
| 33 | Third supporting block | 34 | Fourth supporting block |
| 311 | First slot | 312 | Second slot |
| 313 | Inserting part | 41 | First cross-bar |
| 42 | Second cross-bar | 51 | Third cross-bar |
| 52 | Fourth cross-bar | 53 | Auxiliary cross-bar |
| 61 | Tablecloth | 70 | Storage bag/holder/receiver |
| 701 | Opening part | 702 | Abutting part |
| 703 | Through-hole | 704 | Side wall |
| 705 | Stitch | 80 | Second storage bag/holder/receiver |
| 90 | Third storage bag/holder/receiver | | |

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As shown in FIGS. 1-7, an improved portable folding table comprises a folding frame and a cloth table top arranged on the folding frame. The folding frame comprises a connecting sleeve 11 and four supporting rods hinged to the connecting sleeve 11 respectively. The lower end of each supporting rod is provided with a contact part for contacting with floor. The upper end of each supporting rod is provided with a supporting block 31 for supporting the table top. Each supporting block 31 is arranged with a first slot 311 and a second slot 312, which are perpendicular or substantially perpendicular to each other. The four supporting rods are arranged as the first supporting rod 21, the second supporting rod 22, the third supporting rod 23 and the fourth supporting rod 24 clockwise. Accordingly, the four supporting blocks 3 connected with the supporting rods are arranged as the first supporting block 31, the second supporting block 32, the third supporting block 33 and the fourth supporting block 34. A first cross-bar 41 is arranged between the first slots 311 of the first and second supporting blocks 31 and 32, and the two ends of the first cross-bar 41 are clamped in corresponding two first slots 311 respectively. A second cross-bar 42 is arranged between the first slots 311 of the third and fourth supporting blocks 33 and 34, and the two ends of the second cross-bar 42 are clamped in corresponding two first slots 311 respectively.

The table top comprises a tablecloth 61, as well as a third cross-bar 51 and a fourth cross-bar 52 arranged on both sides at the bottom of the tablecloth 61. The third cross-bar 51 is arranged between the second slots 312 of the second and third supporting blocks 32 and 33, and both ends of the third cross-bar 51 are clamped in the corresponding two second slots 312 respectively. The fourth cross-bar 52 is arranged between the second slots 312 of the fourth and first supporting blocks 34 and 31, and both ends of the fourth cross-bar 52 are clamped in the corresponding two second slots 312 respectively. The bottom of the tablecloth 61 is also arranged with a plurality of auxiliary cross-bars 53 between the third cross-bar 51 and the fourth cross-bar 52. The two ends of each auxiliary cross-bar 53 are arranged on the first cross-bar 41 and second cross-bar 42 accordingly. The number of the auxiliary cross-bars 53 depends on the table size. With more auxiliary cross-bars 53, the supporting effect thereof on the tablecloth 61 is stronger, thereby providing stronger resistance to deformation of the tablecloth 61.

Figure 8:
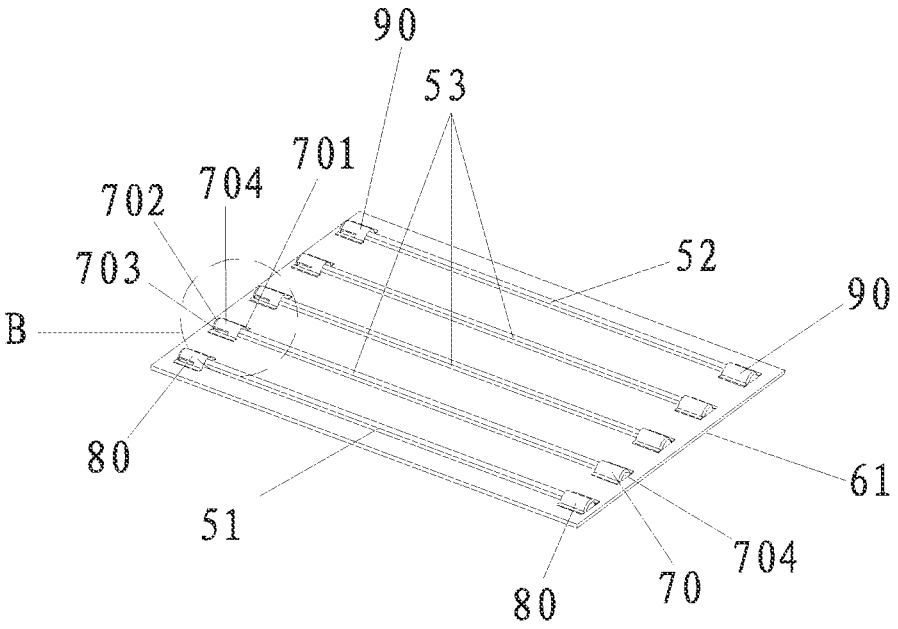
FIG. 8 is a bottom view illustrating an exemplary table top of a portable folding table in accordance with the present invention.
Figure 9:
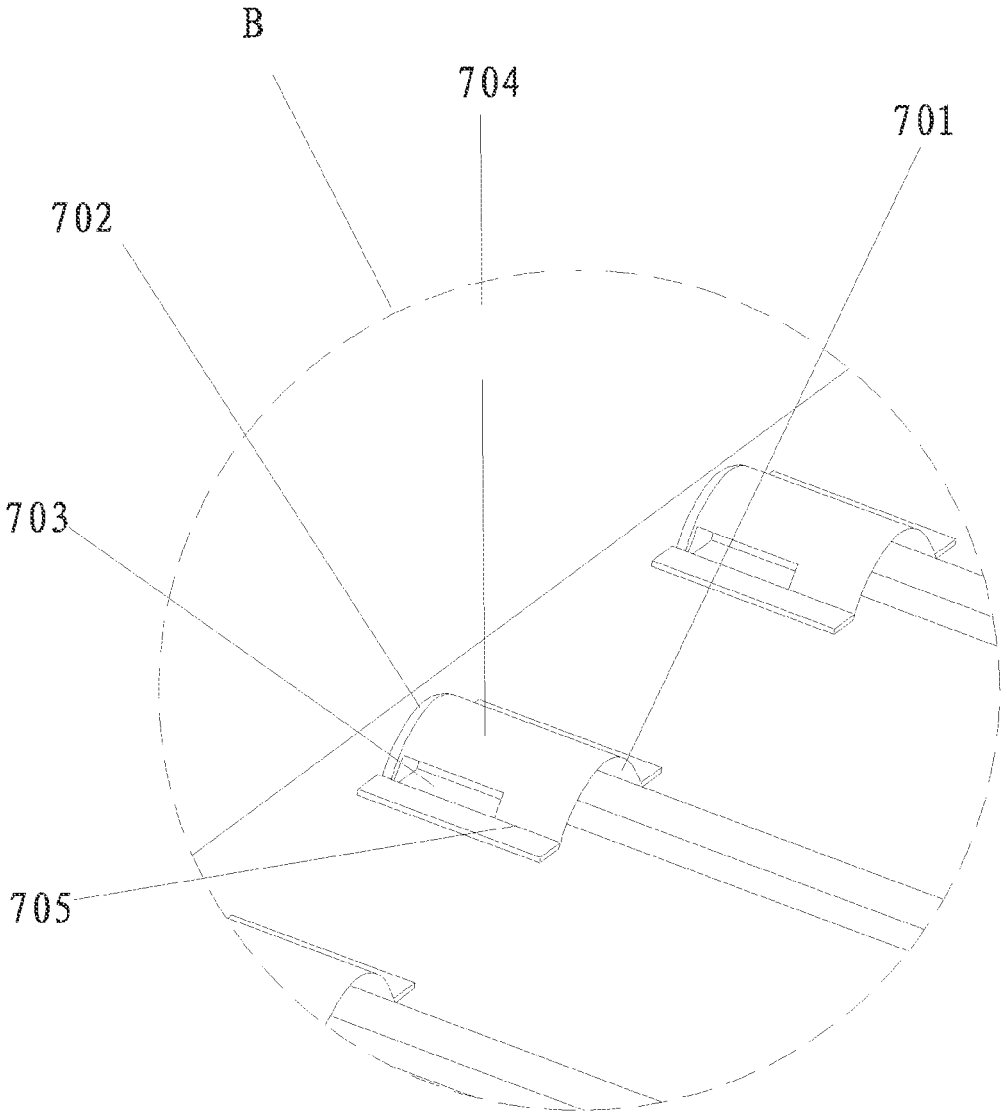
FIG. 9 is an enlarged view of B as shown in FIG. 8.

Referring to FIGS. 8 and 9, there depicts an exemplary portable folding table in accordance with the present invention. The exemplary portable table of the present invention includes a folding frame and a table top arranged on the folding frame. The folding frame is the same as or similar to those illustrated in FIGS. 1-7 and thus, detailed description thereof is omitted. As shown, the present invention includes a plurality of storage bags (or holders, receivers) 70 for receiving corresponding ends of auxiliary cross-bars 53. As used herein, the term "bag" is interchangeable with "holder", "carrier", "receiver" or the like.

In some embodiments, the storage bags 70 are fixed at the bottom of the tablecloth 61, and each provided with an opening part 701 for inserting the auxiliary cross-bar 53 and an abutting part 702 for restricting the auxiliary cross-bar 53 from sliding out. In some embodiments, for each auxiliary cross-bar 53, the present invention includes two storage bags 70 at both ends of the auxiliary cross-bar 53 for receiving corresponding two ends of the auxiliary cross-bar 53 respectively. In such embodiments, at least one storage bag 70 is arranged with a through-hole 703 for the corresponding end of the auxiliary cross-bar to extend between the abutting part 702 and the opening part 701.

The storage bags 70 can be made of various materials such as a fabric the same as or similar to tablecloth 61. The storage bags 70 can also be made in various ways, for instance, by attaching, securing or stitching a piece of fabric to tablecloth 61. In some embodiments, a storage bag 70 is fixed on the tablecloth 61 with stitches 705 on both sides in the width direction of the auxiliary cross-bar 53. Along the section between both sides of the width direction of the auxiliary cross-bar 53, the storage bag 70 is formed with the side wall 704. Along both sides of the length direction of the auxiliary cross-bar 53, one side of the storage bag 70 is stitched on the table top 61 to form the abutting part 702 for the auxiliary cross-bar 53 to abut; the other side is not stitched, thereby forming the opening part 701 for the auxiliary cross-bar 53 to insert in. The abutting part 702, the side wall 704 and the bottom of the table top 61 jointly encircle an inner chamber of the storage bag 70. The width of the inner chamber along the width direction of the auxiliary cross-bar 53 is larger than that of the auxiliary cross-bar 53. The through-hole 703 is arranged on the side wall 704. Such configurations allow the auxiliary cross-bar 53 to move to some extent along the width direction of the auxiliary cross-bar 53, and in the meantime prevents the auxiliary cross-bar 53 from sliding out of the inner chamber.

In some embodiments, the through-hole 703 (e.g., size, shape) is designed according to the width, thickness and/or shape of the auxiliary cross-bar 53 such that the auxiliary cross-bar 53 remains in the storage bag 70 during normal operation (e.g., when in use) but can be pulled out through the through-hole 703 by external force (e.g., by an end user). Generally, the through-hole 703 is positioned at each side of the auxiliary cross-bar 53. Thus, when the auxiliary cross-bar 53 is moving in the storage bag 70 during normal operation, it does not slide out of the through-hole 703. To push out the auxiliary cross-bar 53, external force is required to move the auxiliary cross-bar 53 and turn the ends of the auxiliary cross-bar 53 towards the through-hole 703 accordingly.

Similarly, the third and fourth cross-bars 51 and 52 and the table top 61 may also adopt the same or similar connection mode as with the auxiliary cross-bar 53. For example, in some embodiments, the present invention includes a plurality of second storage bags (or holders, receives) 80 and a plurality of third storage bags (or holders, receives) 90 for receiving the third and fourth cross-bars 51 and 52. In some embodiments, a second storage bag 80 is formed for receiving each end of the third cross-bar 51 and a third storage bag 90 is formed for receiving each end of the fourth cross-bar 52. The configuration and operation of the second and third storage bags are the same as or similar to those of the afore-described storage bag 70, and thus detailed description thereof is omitted.

In some embodiments, the present invention includes a connecting sleeve 11 (referring to FIG. 5) in a substantially cuboid shape and comprising a plurality of guide slots for a plurality of supporting rods to abut (e.g., four guide slots 111 for the four supporting rods to abut). The guide slots 111 run through the top and bottom of the connecting sleeve 11. The plurality of supporting rods (e.g., first, second, third and fourth supporting rods 31, 32, 33 and 34) run through corresponding guide slots 111. In some embodiments, corresponding to the four side walls of the connecting sleeve 11, the four guide slots 111 are laid in the connecting sleeve 11 evenly. Corresponding to the four supporting rods, the four side walls of the connecting sleeve 11 are arranged with a hinged aperture 112 respectively. A hinged shaft connected with the corresponding supporting rod is arranged in the corresponding hinged aperture 112. The supporting rod can be hinged to the connecting sleeve 11 via the hinged shaft. The guide slots 111 are used to guide the supporting rod to rotate accurately. When the folding frame is fully unfolded, the supporting rod abuts on both sides of the guide slot 111. When the folding frame is folded, the supporting rod is in the middle of the guide slot 111. In this structure, when the folding frame is unfolded, the supporting rod is directly rotated to the ends of the guide slot 111. When the folding frame is folded, the supporting rod rotates to the middle of the guide slot 111. Then the four supporting rods are gathered together. It is convenient to fold and unfold the folding frame.

Figure 6:
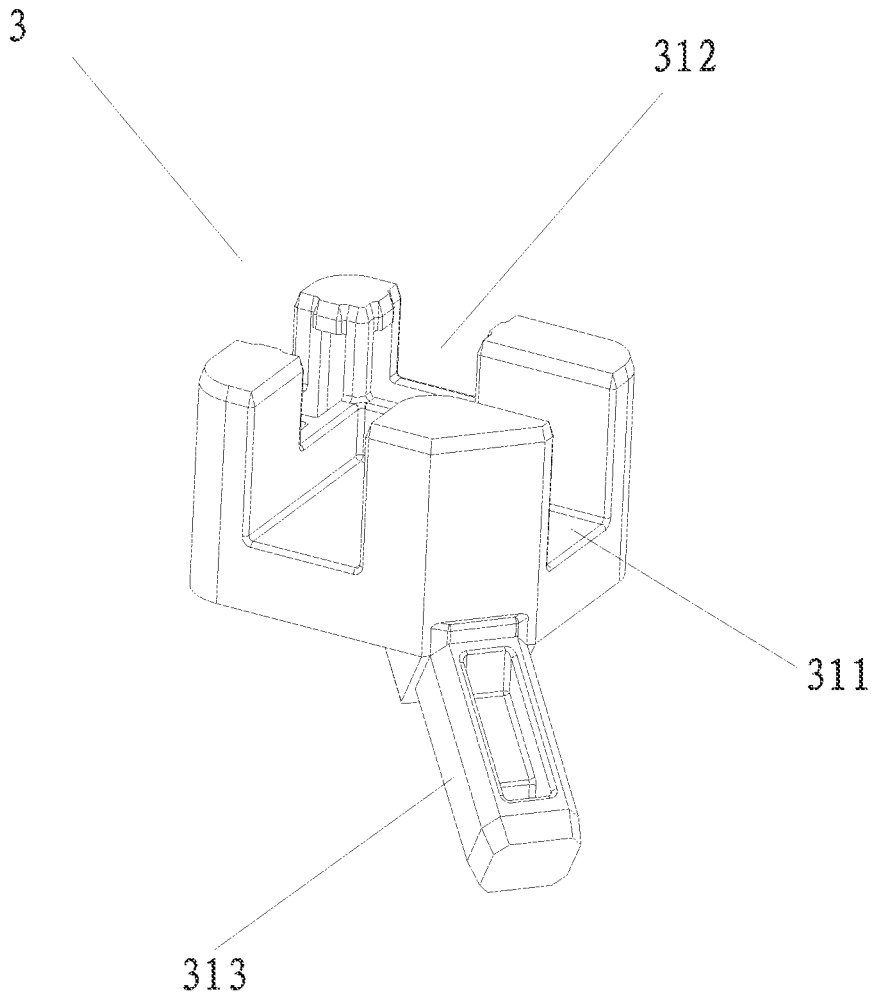
FIG. 6 (Related Art)
FIG. 6 is a structure diagram of the supporting block of the portable folding table in related art.
Figure 7:
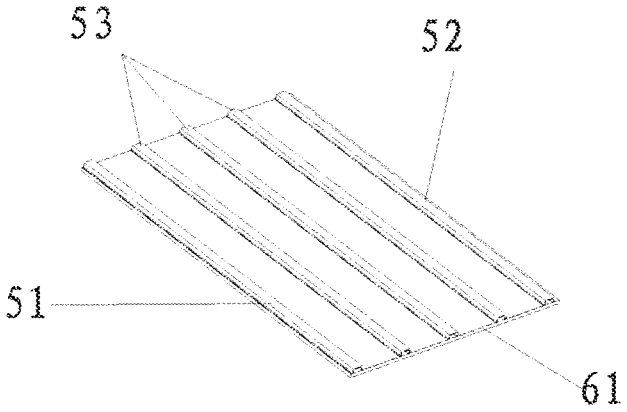
FIG. 7 (Related Art)
FIG. 7 is a bottom view illustrating the table top of the portable folding table in related art.

In an exemplary embodiment, the first and second slots 311 and 312 both extend from the top of the supporting block 3 toward the bottom of the supporting block 3 (referring to FIG. 6). In some embodiments, the depth of the first slot 311 is larger than that of the second slot 312, and the difference equals to or substantially equals to the thickness of the first cross-bar 41. The thickness of the second cross-bar 42 and the auxiliary cross-bar 53 both equals to or substantially equals to that of the first cross-bar 41. In such embodiments, the first and second cross-bars 41 and 42 are placed or clamped in the first slot 311 of the corresponding supporting block, and the third and fourth cross-bars 51 and 52 are then placed or clamped in the second slot 312 of the corresponding supporting block. After the third and fourth cross-bars 51 and 52 are arranged on the first and second cross-bars 41 and 42, the tops of the third and fourth cross-bars 51 and 52 are both flush with the top of the supporting block 3, thereby ensuring a smooth table top. Consequently, any object placed on the table is steady and uneasy to slide, and it's more convenient to use the folding table.

In some embodiments, the supporting rod is tubular, and the supporting block 3 is arranged with an inserting part 313 with caliber matching that of the supporting rod. An aperture may be arranged on the inserting part 313. Corresponding to the inserting part 313, a through-hole is arranged on the supporting rod. Between the aperture and the through-hole, a locking bolt is arranged to further fix the supporting block 3.

For convenience in explanation and accurate definition in the appended claims, the terms "upper" or "lower", "top" and "bottom", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An improved portable folding table comprising:

(A) a folding frame comprising:

(i) a connecting sleeve;

(ii) a plurality of supporting blocks including first, second, third and fourth supporting blocks arranged clockwise, wherein each of the first, second, third and fourth supporting blocks includes a first slot and a second slot;

(iii) a plurality of supporting rods coupled to the connecting sleeve, wherein a lower end of each supporting rod is configured to contact a floor, and an upper end of each supporting rod is connected with a correspond supporting block;

(iv) a first cross-bar disposed in the first slots of the first and second supporting blocks; and (v) a second cross-bar disposed in the first slots of the third and fourth supporting blocks; and (B) a table top supported by the folding frame and comprising:

(i) a tablecloth;

(ii) a third cross-bar formed at a bottom of the tablecloth and along one side of the tablecloth, the third cross-bar configured to be disposed in the second slots of the second and third supporting blocks;

(iii) a fourth cross-bar formed at the bottom of the tablecloth and along another side of the tablecloth, the fourth cross-bar configured to be disposed in the second slots of the fourth and first supporting blocks;

(iv) a plurality of auxiliary cross-bars positioned between the third and fourth cross-bars; and (v) a plurality of holders fixedly attached to the bottom of the tablecloth to receive ends of the plurality of auxiliary cross-bars, wherein each holder includes an opening part for inserting a corresponding auxiliary cross-bar and an abutting part for restricting the corresponding auxiliary cross-bar from sliding out, and two holders are provided to each auxiliary cross-bar, with one holder at each end of the auxiliary cross-bar, wherein at least one holder is formed with a through-hole between the abutting part and the opening part to allow the corresponding end of the auxiliary cross-bar to extend.

2. The improved portable folding table as claimed in claim 1, wherein one or each holder is made of a piece of fabric, wherein both edges of the fabric in a width direction of a corresponding auxiliary cross-bar are stitched to the tablecloth;

one edge of the fabric in a length direction of the corresponding auxiliary cross-bar is stitched to the tablecloth to form the abutting part;

the other edge of the fabric in the length direction of the corresponding auxiliary cross-bar is open to form the opening part;

a through hole is formed in the fabric between the two stitched edges in the width direction of the corresponding auxiliary cross-bar; and the fabric and the bottom of the table top collectively form an inner chamber of the holder, a width of which in the width direction of the corresponding auxiliary cross-bar is larger than that of the corresponding auxiliary cross-bar.

3. The improved portable folding table as claimed in claim 1, further comprising:

a plurality of second holders fixedly attached to the bottom of the tablecloth to receive the third cross-bar, with one second holder at each end of the third cross-bar along a length direction of the third cross-bar, wherein each second holder includes a second opening part for inserting the third cross-bar and a second abutting part for restricting the third cross-bar from sliding out, and at least one second holder is formed with a second through-hole between the second abutting part and the second opening part to allow the corresponding end of the third cross-bar to extend.

4. The improved portable folding table as claimed in claim 1, further comprising:

a plurality of third holders fixedly attached to the bottom of the tablecloth for receiving the fourth cross-bar, with one third holder at each end of the fourth cross-bar along a length direction of the fourth cross-bar, wherein each third holder includes a third opening part for inserting the fourth cross-bar and a third abutting part for restricting the fourth cross-bar from sliding out, and at least one third holder is formed with a third through-hole between the third abutting part and the third opening part to allow the corresponding end of the fourth cross-bar to extend.

5. The improved portable folding table as claimed in claim 1, wherein the plurality of supporting rods includes four supporting rods.

6. The improved portable folding table as claimed in claim 1, wherein the connecting sleeve has a substantially cuboid shape and comprises a plurality of guide slots for the plurality of supporting rods to abut.

7. The improved portable folding table as claimed in claim 6, wherein each slot in the plurality of guide slots extends through the top and bottom of the connecting sleeve.

8. The improved portable folding table as claimed in claim 6, wherein the plurality of guide slots includes four guide slots formed evenly in the connecting sleeve and corresponding to four side walls of the connecting sleeve.

9. The improved portable folding table as claimed in claim 6, wherein the plurality of supporting rods are hinged to the connecting sleeve.

10. The improved portable folding table as claimed in claim 1, wherein the first slot and the second slot of one or each supporting block is substantially perpendicular to each other.

11. The improved portable folding table as claimed in claim 1, wherein the first slot and the second slot of one or each supporting block is substantially perpendicular to each other.

12. The improved portable folding table as claimed in claim 1, wherein the third cross-bar, the fourth cross-bar and the plurality of auxiliary cross-bars are substantially parallel to each other.

* * * * *